United States Patent [19]

Creedon et al.

[11] 4,080,549

[45] Mar. 21, 1978

[54] PLASMA REFLEX DISCHARGE DEVICE

[75] Inventors: John M. Creedon; Sidney D. Putnam, both of Berkeley; Ian D. Smith, Alameda, all of Calif.

[73] Assignee: Physics International Company, San Leandro, Calif.

[21] Appl. No.: 702,521

[22] Filed: Jul. 6, 1976

[51] Int. Cl.[2] ..... H05B 39/00; H05B 41/14

[52] U.S. Cl. ..... 315/98; 313/192; 313/196; 313/231.3; 313/231.4; 313/302; 315/111.2; 315/111.8

[58] Field of Search ..... 315/89, 98, 111.6, 111.8, 315/111.2; 313/260, 261, 259, 189, 420, 231.3, 231.4, 302, 192, 196, 361, 362

[56] References Cited

U.S. PATENT DOCUMENTS

| | | | |
|---|---|---|---|
| 1,987,989 | 1/1935 | Clavier | 313/302 |
| 2,219,033 | 10/1940 | Kuhn et al. | 313/189 X |
| 3,818,375 | 6/1974 | Stapleton et al. | 313/420 |
| 3,989,975 | 11/1976 | Trotel | 313/231.3 |

*Primary Examiner*—Saxfield Chatmon, Jr.
*Attorney, Agent, or Firm*—Robert R. Tipton

[57] ABSTRACT

A high energy discharge apparatus uses a generally electron transparent thin foil anode of various configuration which is arranged parallel to and spaced apart between a pair of cathodes, and energized to create a potential difference between the anodes and cathodes causing electrons to be reflected back and forth through the foil anode with the concurrent discharge of ions being accelerated to the cathode.

13 Claims, 8 Drawing Figures

PLASMA REFLEX DISCHARGE DEVICE

BACKGROUND OF THE INVENTION

This invention relates generally to discharge devices and in particular to discharge devices having a high energy density.

Commonly used prior art devices such as thyratrons, ignitrons, spark gaps, etc., are operated at very high current densities by making use of ionized gases to neutralize the space charge of the electrons flowing from cathode to anode.

In such prior art devices utilizing conventional plasma discharges, positive ions and electrons are introduced as a background gas which is then ionized by various techniques common in the art. The region between the cathode and anode is filled with a plasma comprising low energy electron and ions in which collisions between electrons and ions are an important effect. The electrical current is carried as a conduction current in this plasma.

The plasma reflex discharge apparatus of the present invention differs from these prior art devices in that both the electrons and ions are accelerated into the region between the cathode and anode by the large electric fields used to create a plasma comprising high energy counterstreaming electron and positive ion particles for which particle-particle collisions are not a dominant effect. In the discharge device of the present invention, the source of electrons is at the cathode and the source of ions is at the anode. This combination of multiple reflected electrons and positive ions results in the unique properties of the apparatus of the present invention.

SUMMARY OF THE INVENTION

The apparatus of the present invention comprises, basically, one or more generally electron transparent thin foil anodes arranged parallel to and spaced apart between a pair of cathodes or a cathode and an electron opaque anode, and which are then raised to a potential difference between the cathode and anode by a pulsed energy source to cause electrons to be reflected back and forth through the thin foil anode with a concurrent high density flow of ions to the cathode.

It is therefore, an object of the present invention to provide an apparatus for the multiple reflection of electrons through a thin foil anode.

It is a further object of the present invention to provide an apparatus for controlling the flow of current between an anode and a cathode.

It is another object of the present invention to provide an apparatus for producing a high density flow of ions.

It is still a further object of the present invention to provide an apparatus for switching high currents.

It is yet another object of the present invention to provide an apparatus for pumping a gas filled laser.

It is still another object of the present invention to provide an apparatus for electron heating of a plasma.

It is yet a further object of the present invention to provide a device for the velocity bunching of ions.

It is another object of the present invention to provide a device for high density ion bombardment of a nuclear fusionable material.

It is another object of the present invention to provide a device for producing neutrons from the controlled fusion of a nuclear fusionable material.

These and other objects of the present invention will be manifest upon study of the following detailed description, when taken together with the drawings.

DESCRIPTION OF THE PREFERRED EMBODIMENT

Figure 1:
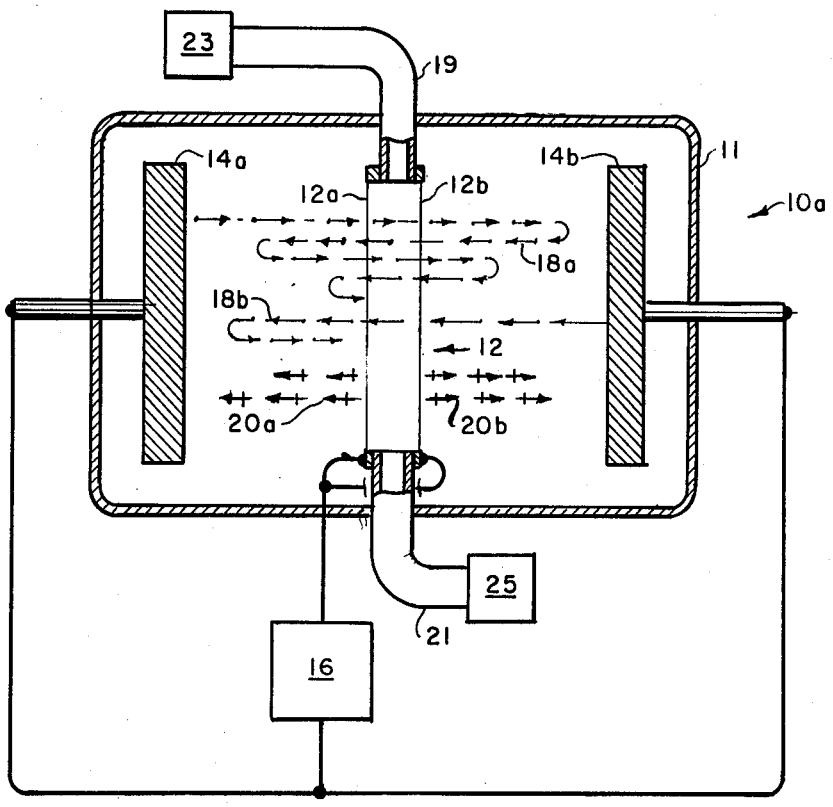
FIG. 1 is an elevational sectional view of the apparatus of the present invention utilizing a foil anode arrangement between two cathodes.

With reference to FIG. 1, there is illustrated the basic configuration of the reflex diode 10 of the present invention, which comprises, basically, an evacuated chamber or housing 11 in which are disposed a generally planar, generally or semi-electron transparent thin foil anodes **12*a* and 12*b* defining anode member 12 arranged parallel to and spaced apart between two generally planar cathodes 14 (14*a* and 14*b*) with power supply 16 used to create a potential difference between cathodes 14 and anodes 12**.

A pair of conduits 19 and 21 are arranged in fluid communication with the space between foil anodes **12*a* and 12*b* for the purpose of evacuating the space using vacuum pumps enclosed in housings 23 and 25 or to introduce gases into the same space which are also contained in housings 23 and 25, to be acted upon by the electrons passing through anode member 12**. Such gases can include laser pumpable gases such as Carbon Dioxide.

Although anodes **12*a* and 12*b* and cathodes 14*a* and 14*b*** are shown as generally planar in the figures, they need not be limited to that configuration but may also be in the form of parallel surfaces which can be concentric cylinders, concentric spheres or other shapes not necessarily parallel.

It will be noted for the present invention the apparatus configuration is generally symmetric either about a single or group of anodes or a single or group of cathodes and, for this reason, each symmetrical pair of anodes or cathodes will be designated by a single element number either without a suffix letter or followed by the suffix letter "*a*" or "*b*" when referring to a particular left hand or right hand element, respectively.

When such a potential difference is created, electrons will flow, as shown by electron trajectories 18*a* and 18*b* toward anode 12 to pass through the semi-transparent foils 12*a* and 12*b* and then be reflected back and forth across anode member 12.

Concurrently, ions will flow, as shown by ion trajectories 20 toward cathodes 14*a* and 14*b*, in the opposite direction from the electron flow.

Thus, basically, the discharge of reflex diode 10 comprises multiply reflected electrons and a counter stream of positive ions.

The electrons are oscillated between cathode 14*a* and 14*b* to the anode 12 by virtue of the potential difference created by power supply 16. Although it may be possible to apply a continuous direct current potential to anode member 12 and cathodes 14*a* and 14*b*, the apparatus of the present invention and power supply 16 contemplate the use of a high energy pulsed voltage to produce an intermittent pulsed electron potential difference.

The high energy electrons which reach anode member 12, pass through the thin foils 12*a* and 12*b* thereof and are reflected by the electric fields on the other side caused by the oppositely disposed cathode. The electrons make several transits through anode 12 before coming to rest. The positive ions emitted by the plasma covering the anode surfaces are accelerated toward both cathodes 14*a* and 14*b*.

Under certain conditions, the current densities of the electrons leaving cathodes 14*a* and 14*b*, and the positive ions leaving anode 12, can become orders of magnitude greater than the space charge limited values of electron and ion currents which would flow in the absence of multiply reflected electrons. Basically, these high currents are due to the partial neutralization of the space charge of the multiple reflected electrons by the positive ions.

The use of a thin foil anode or some other means to produce the energy and angular distribution of the electrons, which is required for high current flow, is essential to the operation of the reflex discharge apparatus 10 of the present invention.

As used to describe the thin foil anode of the present invention, the term "generally transparent" and "semi-transparent" is intended to mean a thin foil for which as electron loses a fraction of its energy during each pass through the foil.

The unique features of the device of the present invention are associated with certain charge and potential distributions in the anode-cathode region. These charge and potential distributions are a direct consequence of the energy and angular distribution of the electrons which are produced by the energy loss and scattering of the electrons in the anode, or by some equivalent means such as a magnetic field or particle plasma. For mesh anodes, most of the electrons either pass through the anode with no energy loss or are stopped completely. The resulting energy spectrum does not produce the high currents found in the plasma reflex apparatus 10 of the present invention.

Figure 2:
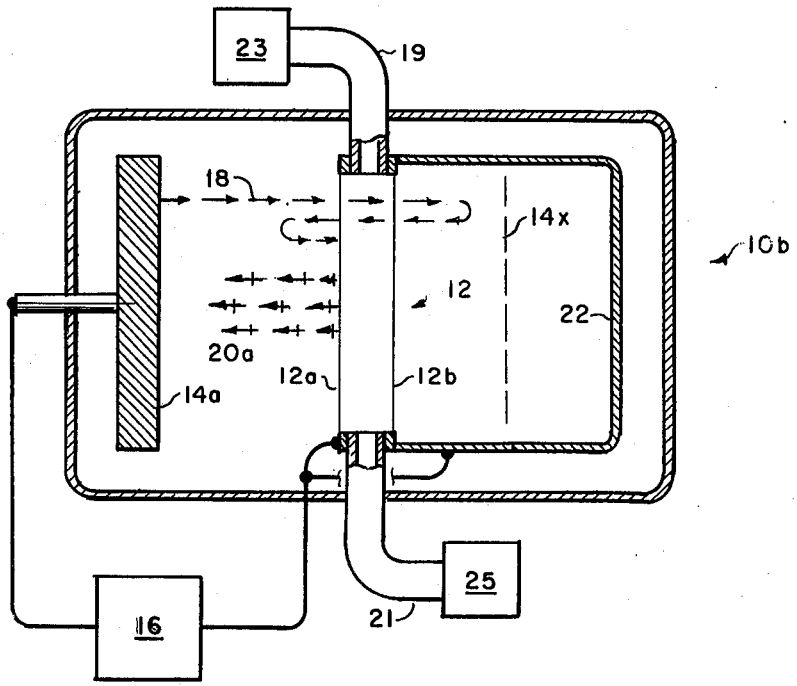
FIG. 2 is an elevational sectional view of the apparatus of the present invention utilizing an electron opaque anode to create a virtual cathode in place of a real cathode.

With reference to FIG. 2, there is illustrated a reflex discharge apparatus 10*b* of a configuration similar to the reflex diode 10*a* of FIG. 1 however, with cathode 14*b* replaced by electron opaque anode 22 used to create a virtual cathode 14*x* indicated by the dashed line. Virtual cathode 14*x* is created because of the potential well induced by the space charge of the electrons. Anode 22 is, of course, electrically connected to anode 12 and maintained at the same potential.

Other techniques and apparatus may also be used to create a virtual cathode such as a magnetic mirror or similar electromagnetic devices, or other electrostatic devices.

Figure 3:
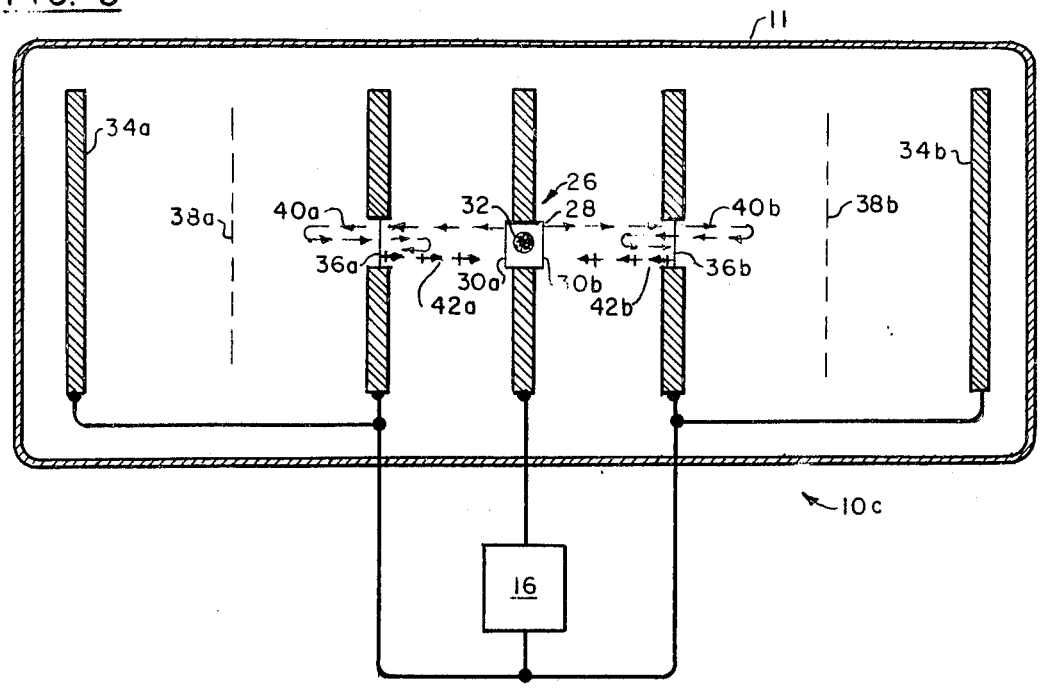
FIG. 3 is an elevational sectional view of the apparatus of the present invention for achieving ion bombardment of a specimen in a cathode disposed between two electron transparent foil anodes having outer electron opaque anodes.

With reference to FIG. 3, there is illustrated a configuration for the reflex diode device 10*c* of the present invention for ion bombardment of a specimen material and comprises, basically, a cathode 26 in which is contained a specimen holder 28 having generally ion transparent windows or foils 30*a* and 30*b* and containing specimen 32.

Cathode 26 is arranged parallel to and spaced apart between electron opaque anodes 34*a* and 34*b* disposed outermost along with generally electron transparent thin foil anodes 36*a* and 36*b* disposed, respectively, parallel to and spaced apart between anode 34*a* and cathode 26, and between anode 34*b* and cathode 26, respectively.

By virtue of the spaced apart relation of anodes 34*a*, 36*a* and 34*b*, 36*b*, virtual cathodes 38*a* and 38*b* are, respectively, created between anode 34*a* – 36*a* and anodes 34*b* – 36*b*.

Thus, the "*a*" and "*b*" sides of the reflex discharge apparatus apparatus 10*c*, define twin diodes having a common real cathode.

Anodes 34*a*, 34*b*, 36*a*, and 36*b* are all electrically connected together and are maintained at the same potential.

Power supply 16, as in FIGS. 1 and 2, is used to energize and create a potential difference between the anodes and cathodes of reflex discharge apparatus 10*c*.

When energized by a high voltage pulse, electrons are emitted from cathodes 26 and are accelerated toward anodes 36*a* and 36*b* for multiple reflection through foil anodes 36*a* and 36*b* as shown by electron trajectories 40*a* and 40*b*, respectively. Concurrently, a high density flow of ions are emitted from anodes 36*a* and 36*b* and are accelerated toward cathode 26, through ion transparent windows, grids or foils 30*a* and 30*b* where they are caused to collide with and bombard specimen 32.

Figure 4A:
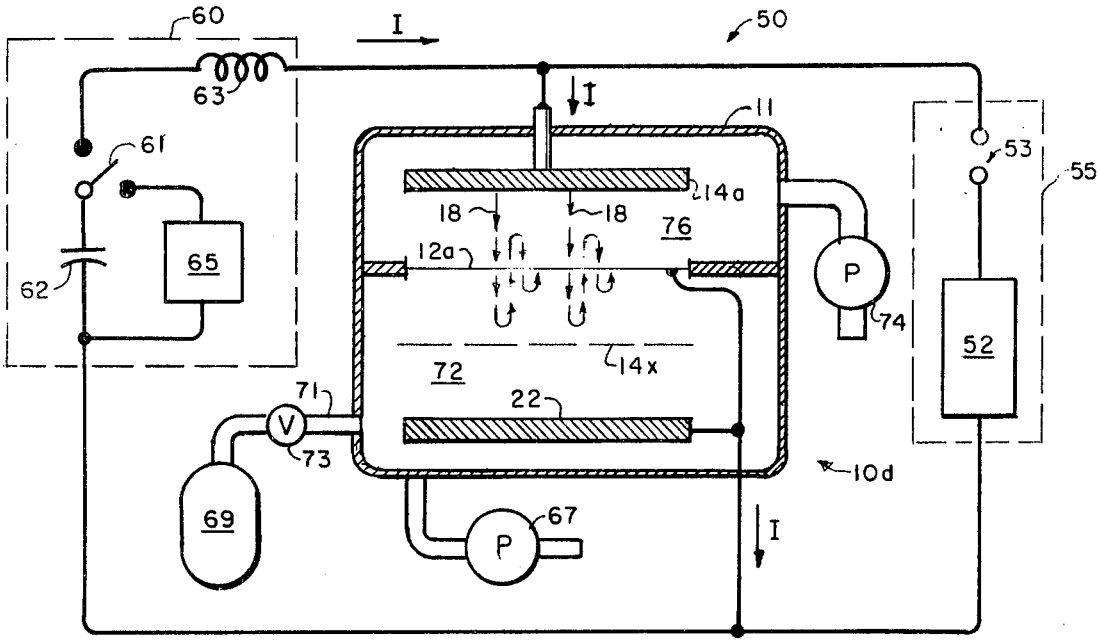
FIG. 4A is a partial diagramatic and elevational, sectional view of the apparatus of the present invention being employed as a switch shown in the "on" condition.
Figure 4B:
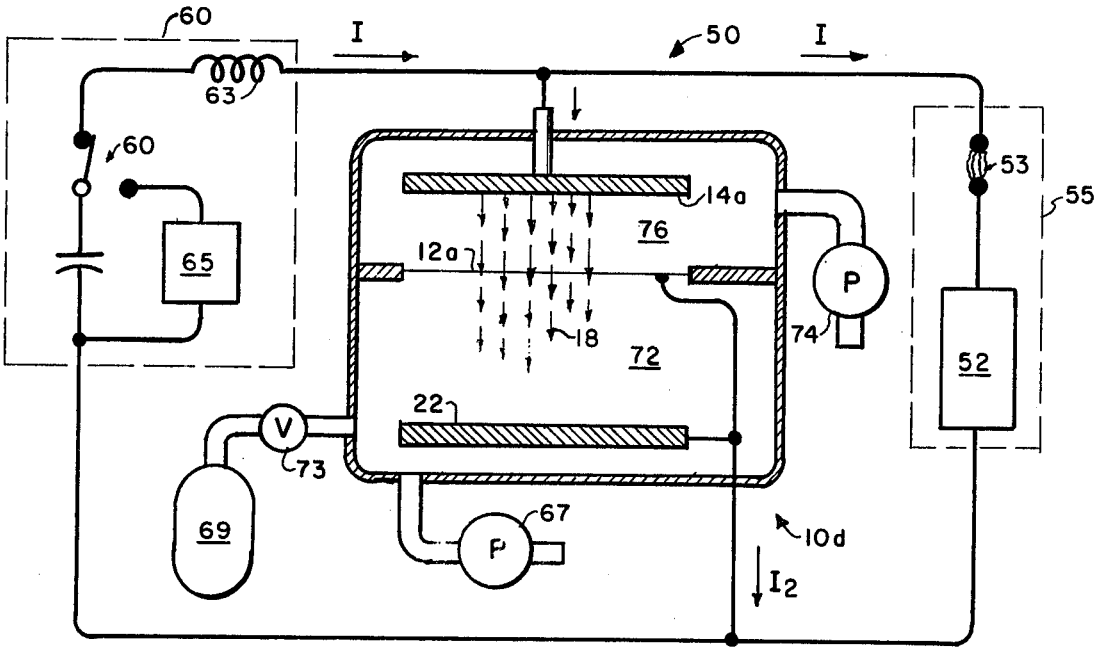
FIG. 4B is a partial diagramatic and elevational, sectional view of the apparatus of the present invention being employed as a switch shown in the "off" condition.

With reference to FIGS. 4A and 4B, there is illustrated the use of the plasma reflex device apparatus 10*d* of the present invention as a high energy switch 50.

Basically, reflex discharge device 10*d* of FIG. 4A is identical to reflex discharge 10*b* of FIG. 2, and comprise thin anode foil 12*a* disposed parallel to and spaced apart between cathode 14*a* and electron opaque anode 22, which creates virtual cathode 14*x*.

However, the switch 50 of FIG. 4A and 4B further comprises an energy absorbing load 52 connected in series with pulse operated switch 53 (spark gap) to define an energy absorbing load circuit 55 which is connected between cathode 14*a* and anodes 12*a* and 22.

An energy storage circuit 60 comprises a switch 61, capacitor 62 and an induction coil 63 all connected in series and energized by power supply 65, which circuit 60 is also connected between cathode 14*a* and anodes 12*a* and 22.

Also included as a part of high energy switch 50 is vacuum pump 67 used to evacuate chamber 72 within housing 11 of most of its gases and ionizable gas supply 69 which is in fluid communication with chamber 72 through conduit 71 and whose flow is controlled by valve 73.

Housing 11 is divided into two chambers 72 and 76, by thin foil anode 12*a*. A second vacuum pump 74 is arranged in fluid communication with chamber 76 to create a high vacuum on the cathode side of anode 12*a*.

To operate switch 50 of the present invention, chamber 72 and 76 are evacuated to a condition permitting the electrons to be accelerated from cathode 14*a* and be reflected back and forth across anode 12*a* as shown by electron trajectory 18.

The operating characteristics of the reflex discharge device 10*d* of the present invention are essentially those of a constant voltage device in which the voltage is determined by the thickness of the anode foil, and, within limits, is independent of the current, the anode-cathode spacing or the cathode area. The current through reflex discharge device 10*d* is determined, essentially, by the external circuitry, and is orders of magnitude greater than the Langmuir-Child current corresponding to the operating voltage.

Initially, the region between anodes 12*a* and 22 (chamber 72) is filled with a gas from gas supply 69 at a low pressure, low enough to initially keep the gas from being ionized.

Switch 61 is switched to permit capacitor 62 to become charged by power supply 65. After capacitor 62 is fully charged by power supply 65, switch 61 is then switched over to connect capacitor 62 in series with induction coil 63 and reflex discharge device 10*d*. As the current "I" initially begins to flow through induction coil 63 it will also initially begin to flow through diode 10*d*, in particular, from cathode 14*a* through foil anode 12*a* and then reflected to make multiple passes through anode 12*a* such that virtually all of the initial current flows through reflex discharge device 10*d* and back to the other side of capacitor 62. In other words, the electrons which are accelerated from cathode 14*a* to anode 12*a* through which they penetrate, create a space charge and virtual cathode 14*x* by which they are reflected back to anode 12*a* to make multiple transits therethrough. This combination of multiple reflected electrons and positive ions flowing from anode 12*a* to cathode 14*a*, creates a total net current "I" which may be very large for even small values of the potential difference between cathode 14*a* and anode 12*a*.

Switching of reflex discharge device 10*d* occurs when the gas between anodes 12*a* and 22 breaks down and becomes a good conductor eliminating virtual cathode 14*x* as shown in FIG. 4B, causing reflex discharge apparatus 10*d* to revert to those conditions appropriate for Langmuir bipolar flow of current "I" which is substantially less current flow than when operating in the multiple reflected electron flow mode of FIG. 4A.

When this change in characteristics occurs, the effect is the same as that of converting reflex discharge device 10*d* into a high resistance thereby producing a rapid and very large increase in voltage across reflex discharge device 10*d*. When this voltage is sufficiently high to cause impulse switch (spark gap) 53 to close (arc over), the high voltage is then placed across energy absorbing load 52 causing the energy stored in induction coil 63 to then be transferred to load 52.

The time at which the gas breaks down and causes the switch 10*d* to open can be controlled by varying the gas pressure or the spacing between 12*a* and 22, or by such external means (not shown) such as a separate electrical discharge in the gas in chamber 72.

Figure 5A:
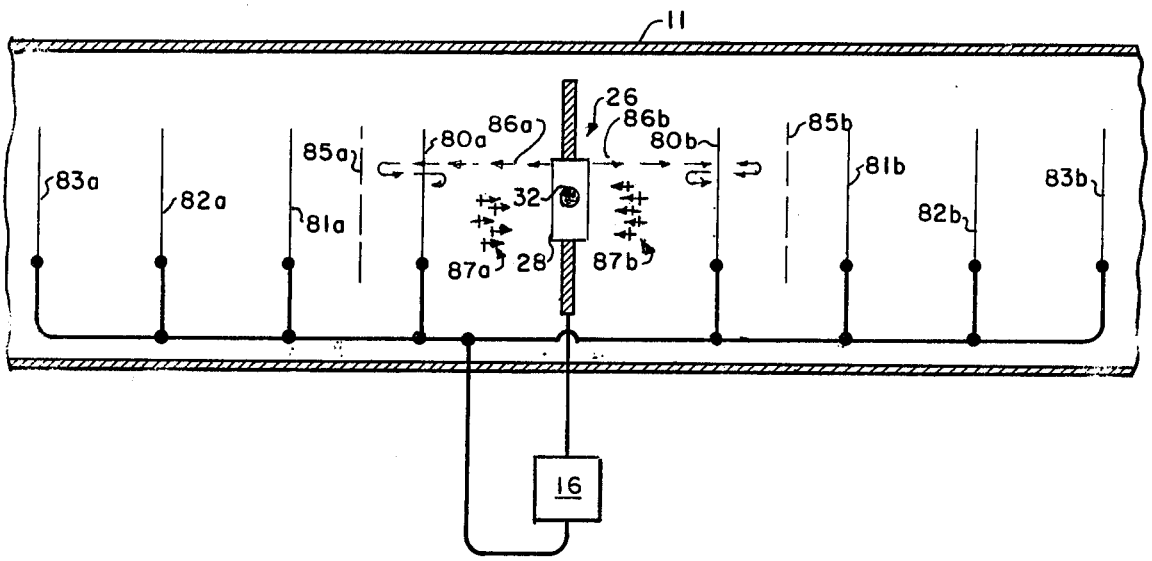
FIG. 5A is partial elevational sectional view of the apparatus of the present invention illustrating the use of multiple anodes to create velocity bunching of ions during one time period.
Figure 5B:
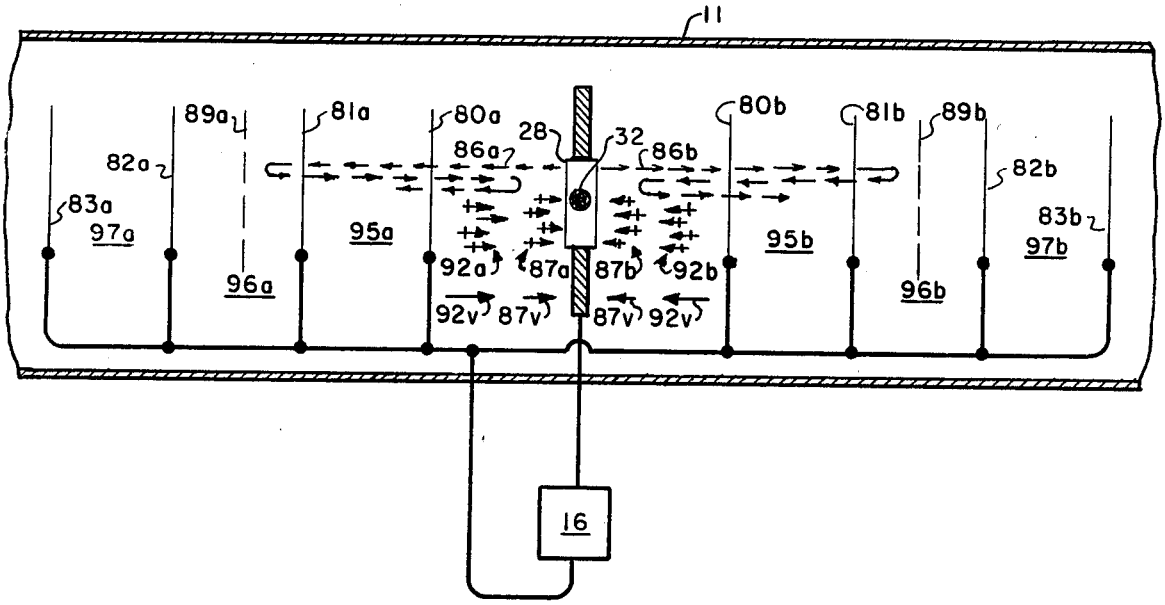
FIG. 5B is a partial elevational sectional view of the apparatus of the present invention illustrating the use of multiple anodes to create velocity bunching of ions during a second and later time period.

With reference to FIGS. 5A and 5B, there is illustrated a cathode-anode configuration in which ions can be concentrated at the specimen by step increases in velocity of subsequent pulses or bunches of ions, i.e. "velocity bunching".

The release of fusion energy from either pellets containing nuclear fusionable materials such as deuterium or tritium, or a magnetically contained particle plasma, require very concentrated heating in order to achieve a fusion reaction. By use of the apparatus illustrated in FIGS. 5A and 5B, high concentrations of ions can be achieved.

The apparatus of FIG. 5A is basically similar to that of FIG. 3 in that a cathode 26 includes a specimen holder 28 containing a sample 32, and is disposed equidistantly between a plurality of spaced apart anodes 80*a*–80*b*, 81*a*–81*b*, 82*a*–82*b*, and 83*a*–83*b*, all of which are electrically interconnected and maintained at the same potential with respect to cathode 26.

A power supply 16 is used to create the potential difference between anodes 80 through 83 and cathode 26.

An ion transparent window, grid or foil 30*a* and 30*b* is provided on each end of specimen holder 28 to enclose sample 32 within holder 28.

Anodes 80*a*–80*b*, 81*a*–81*b*, 82*a*–82*b* and 83*a*14 83*b* are spaced apart and parallel to each other to define spaces 95*a*–95*b*, 96*a*–96*b* and 97*a*–97*b*. Between each anode is an ionizable gas at a low pressure, about 50 microns, with the specific gas pressure between anodes 80*a* and 81*a* (space 95*a*), and between 80*b* and 81*b* (space 95*b*), respectively, set to ionize or break down sequentially just after the beginning of the pulse. The gas pressure between anodes 81*a*–82*a* (space 96*a*), and 81*b*–82*b* (space 96*b*), respectively, is set to ionize or break down a short time later during the pulse. The gas pressure between anodes 82*a*–83*a* (space 97*a*) and 82*b*–83*b* (space 97*b*), is set to break down still later during the same pulse.

To operate the apparatus of FIG. 5A, a high voltage pulse is applied across cathode 26 and anodes 80*a*–80*b* through 83*a*–83*b* by pulsed power supply 16.

At the beginning of the pulse, and prior to breakdown of the gas in space 95*a* between anodes 80*a*–81*a* and space 95*b* between anodes 80*b*–81*b*, virtual cathodes 85*a* and 85*b* are established between the respective anodes causing electrons emitted by cathode 26 to be reflected back and forth across anodes 80*a*–80*b* as illustrated by electron trajectories 86*a* and 86*b*. Concurrently, a group of ions 87*a*–87*b* will be emitted and accelerated from anodes 80*a* and 80*b* toward cathode 26 and specimen 32.

After the gas in space 96*a* between anodes 80*a*–81*a* and space 96*b* between anodes 80*b*–81*b* breaks down, as shown in FIG. 5B, the effective thickness of the anode increases and thus the operating voltage of the diode increases and a virtual cathode 89*a*–89*b* is formed in space 96*a* between anodes 81*a*–82*a* and in space 96*a* between anodes 81*b*–82*b*, respectively, with the electrons being reflected back and forth through anodes 80*a*–81*a* and 80*b*–81*b* as shown by electrons trajectories 86*a* and 86*b*.

At this higher voltage, a group of ions 92*a* and 92*b* are accelerated from anodes 80*a*–81*a* and 80*b*–81*b* at a higher velocity, as indicated by arrow 92*v*, than the previous groups 87*a* and 87*b*, as indicated by shorter arrow 87*v*, such that the arrival time at specimen 32 of ion groups 92*a*–92*b* is the same as the arrival time of the previous emitting groups of ions 87*a*–87*b*. In a like manner, when the gas in space 97*a* between anodes 82*a*–83*a* and in space 97*b* between anodes 82*b*–83*b*, respectively, breaks down, a further increase in voltage occurs to accelerate a third bunch or group of ions from the anodes at an even higher velocity, also to arrive at specimen 32 at the same time as ion groups 87*a*–87*b* and 92*a*–92*b*. Thus a very high concentration or density of ions can be achieved at the location of specimen 32 for each pulse.

Figure 6:
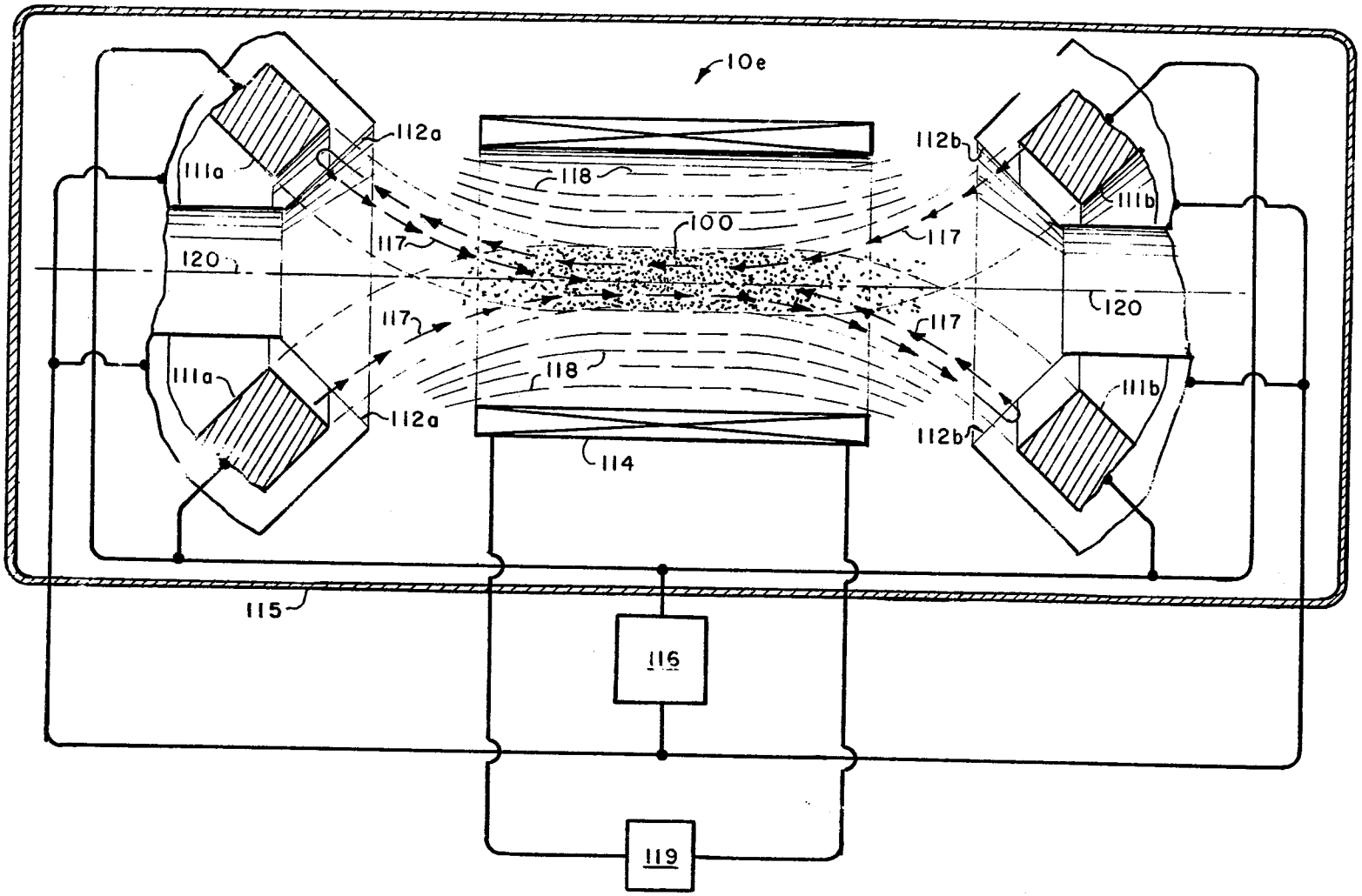
FIG. 6 is a partial sectional view of the apparatus of the present invention illustrating its use to heat a plasma.

With reference to FIG. 6, there is illustrated a reflex discharge device 10*e* used to heat a plasma 100.

Basically, the apparatus of diode 10*e* comprises a pair of rings cathodes 111*a* and 111*b* about which and spaced apart therefrom are concentric hollow, thin foil anodes 112 and 112*b*, respectively.

An elongated magnetic coil 114 is provided between rings 112*a*–112*b* and 111*a*–111*b* for the purpose of controlling the trajectory 17 of electrons emitted from cathodes 111*a* and 111*b*.

The entire combination is contained in evacuated housing 115.

A power supply 116 is used to create the high voltage between anodes 112*a*–112*b* and cathodes 111*a*–111*b*.

The spacing between anodes 112*a* and 112*b* is made large compared to the diameter of plasma 100 such that, although the loss of plasma out of the ends of the plasma body may be large, the total loss will be relatively small when compared with the total plasma volume. For example, for a plasma diameter of a few centimeters, the distance between anodes 112*a* and 112*b* can be of the order of 100 meters.

To operate discharge device 10*e* of FIG. 6, housing 115 is evacuated and filed to a relatively low pressure, about 50 microns, with an ionized or unionized gas. Magnet coil 114 is energized by a second power supply 119 to create a magnetic field as show by magnetic lines of force 118. A voltage pulse is generated by power supply 116 causing electrons to be emitted from cathode 111*a* and 111*b*, whereby they follow magnetic lines of force 118 through anodes 112*a* and 112*b* where they are reflected back and forth through anodes 112*a* and 112*b* as indicated by electron trajectories 117, several times before losing their energy to heat plasma 100. It can be seen that magnet 114 causes the electrons to be highly concentrated along axis of rotation 120 of ring cathodes 111*a*–111*b* and thus the plasma ions are rapidly heated to create a very concentrated cylinder of plasma 100 whose longitudinal axis is coincident with axis 120 of ring cathode 111*a*–111*b* and thus ionize and rapidly heat a very concentrated cylinder of gas or plasma 100 coincident with axis 120.

We claim:

1. A reflex diode comprising
means defining an evacuated chamber,
a pair of cathodes arranged spaced apart from each other in said chamber
a generally electron transparent thin foil anode disposed between, and spaced apart from said cathodes, in said chamber, whereby electrons are multiply reflected between said cathodes and
means for creating an electrical potential difference between said cathodes and said anode.

2. The reflex diode as claimed in claim 1 wherein said anode comprises
a pair of generally electron transparent thin foil first and second anodes arranged parallel to and spaced apart from each other and arranged spaced apart between said cathodes, in said chamber.

3. The reflex diode as claimed in claim 2 further comprising
an energized particle plasma disposed between said first and second anodes.

4. The reflex diode as claimed in claim 2 further comprising
a laser pumpable gas disposed between said first and second anodes.

5. A reflex diode comprising
means defining an evacuated chamber,
a cathode disposed in said chamber,
a first electron opaque anode disposed spaced apart from said cathode in said chamber,
a second generally electron transparent thin foil anode disposed spaced apart between said cathode and said first anode and electrically connected to said first anode in said chamber, whereby a virtual cathode is created between said first and second anodes, and
means for creating an electrical potential difference between said cathode and said two anodes.

6. The reflex diode as claimed in claim 5 further comprising,
a third generally electron transparent anode, arranged spaced apart from said second anode between said cathodes and said first anode.

7. The reflex diode as claimed in claim 6 further comprising,
an energized particle plasma disposed between said second and third anodes.

8. The reflex diode as claimed in claim 6 further comprising,
a laser pumpable gas disposed between said first and second diodes.

9. A reflex diode comprising,
means defining an evacuated chamber,
a cathode disposed within said chamber comprising a pair of electrically connected, generally ion transparent spaced apart windows,
a first anode arranged and spaced apart from said cathode in said chamber,
a second electron transparent thin foil anode disposed spaced apart between said cathode and said first anode and electrically connected to said first anode in said chamber, whereby a virtual cathode is created between said first and second anodes, and
means for creating an electrical potential difference between said cathodes and said anodes.

10. The reflex diode as claimed in claim 9 further comprising, a nuclear fusionable material disposed between said pair of ion transparent windows in said cathode.

11. The reflex diode as claimed in claim 9 further comprising, a plurality of spaced apart, generally electron transparent thin foil anodes disposed between said second anode and said cathodes and electrically connected to said first and second anodes.

12. A reflex diode comprising
means defining an evacuated chamber,
means for evacuating said chamber,
means for introducing an ionizable gas into said chamber,
a cathode disposed in said chamber,
a first anode disposed spaced apart from said cathode in said chamber,
a second generally electron transparent thin foil anode disposed spaced apart between said cathode and said first anode and electrically connected to said first anode in said chamber, an energy absorbing load circuit comprising an energy absorbing load connected in series with a pulse operated switch said energy absorbing load circuit connected between said anodes and said cathode, an energy storage circuit connected between said cathode and said anodes and comprising a switch, a capacitor connected in series with said switch, an induction coil connected in series with said capacitor and switch, and means for energizing said energy storage circuit.

13. A reflex diode comprising, means defining a housing, a plasma contained within said housing, a pair of annular cathodes spaced apart within said housing having a common axis of rotation, a pair of hollow, generally electron transparent, thin foil anodes spaced apart between said annular cathodes and having a common axis of rotation with said cathodes, means for creating a generally cylindrical magnetic field between said pair of cathodes and anodes and having lines of force arranged equally disposed about said common axis and with lines force diverting outwardly toward said anodes and cathodes proximate the ends of said magnetic field, and means for creating an electrical potential difference between said cathodes and said anodes.

* * * * *